United States Patent [19]

DiCarlo

[11] Patent Number: 4,997,001

[45] Date of Patent: Mar. 5, 1991

[54] CONVERTIBLE CANE

[76] Inventor: Tom R. DiCarlo, 502 N. Main Street, Mount Prospect, Ill. 60056

[21] Appl. No.: 403,336

[22] Filed: Sep. 6, 1989

[51] Int. Cl.[5] ..... A45B 9/04

[52] U.S. Cl. ..... 135/65; 135/77; 135/68

[58] Field of Search ..... 135/65, 67, 75, 77, 135/68, 69, 70, 78–81

[56] References Cited

U.S. PATENT DOCUMENTS

| | | | |
|---|---|---|---|
| 90,498 | 5/1869 | Chapman . | |
| 1,504,902 | 8/1924 | Rosenhein, Jr. . | |
| 2,210,493 | 8/1940 | Lisi | 135/47 |
| 2,409,365 | 6/1945 | Lamb | 135/49 |
| 3,177,884 | 4/1965 | Thro | 135/54 |
| 3,280,831 | 10/1966 | Parker | 135/68 |
| 3,289,685 | 12/1966 | Parker | 135/45 |
| 4,044,784 | 8/1977 | Smith | 135/75 |
| 4,085,763 | 4/1978 | Thomas | 135/69 |
| 4,091,828 | 5/1978 | Jorgensen | 135/66 |
| 4,098,283 | 7/1978 | Tritle, Jr. | 135/77 |
| 4,314,576 | 2/1982 | McGee | 135/67 |
| 4,481,964 | 11/1984 | Minneman | 135/66 |
| 4,562,851 | 1/1986 | Frank | 135/78 |
| 4,601,302 | 7/1986 | Breen et al. | 135/66 |

FOREIGN PATENT DOCUMENTS

| | | | |
|---|---|---|---|
| 311429 | 7/1917 | Fed. Rep. of Germany | 135/77 |
| 1246463 | 10/1960 | France | 135/77 |
| 0654996 | 3/1986 | Switzerland | 135/70 |
| 685781 | 1/1953 | United Kingdom | 135/77 |
| 1181795 | 2/1970 | United Kingdom | 135/77 |

*Primary Examiner*—David A. Scherbel
*Assistant Examiner*—Lan Mai
*Attorney, Agent, or Firm*—Fitch, Even, Tabin & Flannery

[57] ABSTRACT

A cane assembly, which is easily convertible between a single-tipped cane and a multitipped cane by operation of a single screw or nut, also includes an adjustable height shaft and enlarged pads on the arms of the multitipped cane to provide greater stability and load distribution to the cane assembly.

12 Claims, 1 Drawing Sheet

CONVERTIBLE CANE

BACKGROUND OF THE INVENTION

The present invention provides a cane assembly and more particularly an assembly operable between a monopod and a multitipped cane arrangement.

These canes or ambulatory aids are generally utilized to assist in walking for infirm patients, elderly individuals with walking disabilities or other persons requiring assistance to maintain their balance or in need of support. The present invention provides the user with a degree of mobility and is not specifically intended for use as a novelty or fashionable dress item. A common walking stick is illustrated in U.S. Pat. No. 2,210,493 to Lisi and may be both functional and fashionable, but is only a cane abruptly ending at a relatively sharp point.

Mobility and movement for a recovering patient or infirm individual is often a difficult procedure and any aid or movement-assisting device is useful to such person to avoid confinement to a bed or wheelchair. Canes and crutches have been utilized for many decades, but minimal development to these apparatus has been provided in recent years. Therefore, the injured or infirm party is left to utilize the available equipment, which is sometimes inadequate for specific parties or in particular situations.

The need to accommodate individual circumstances is highlighted by earlier cane and crutch structures. Cane and crutch structures must be adjusted to the user's height. Indicative of the various means proposed for varying the height of the cane or crutch are a walking stick with a multitipped pod at its end shown in U.S. Pat. No. 3,289,685 to Parker. The stick has a shaft extending from the pod and an upper tubular portion matable with the shaft. A pair of bolts passes through aligned holes in the mating shaft and tube to secure them. However, an alignment bar is required in the tubular member to mate with a slot in the shaft. The illustrated quadrapod is a very narrow arrangement with small annular pads, which may not provide the necessary resistance to slipping, thus exposing the user to an unstable or a precarious position. In addition, setting the initial height of the lower pod requires manually cutting the upright tubular shaft of the lower pod. Further, the monopod tip must be removed and replaced when changing between the separate modes. Another height-adjustable structure is illustrated in U.S. Pat. No. 2,409,365 to Lamb, which provides a pair of mated threaded members at the lower end of a crutch for screw-adjusting the crutch height, and a lock-screw to secure the height setting.

A quad cane assembly is illustrated in U.S. Pat. No. 4,085,763 to Thomas, which assembly is height-adjustable and has a stabilizing collar for balance and control for the user. Another quad bottom cane is disclosed in U.S. Pat. No. 4,601,302 to Breen et al., which provides male and female threaded coupling members for either a quad bottom cane assembly or a walking cane with a single contact point. A locknut on the male thread is adjusted to secure the height of the mated members.

The above-noted cane assemblies generally have a cane tip to fit over the surface-contacting point or points, which tip may serve as a wearing pad, an anti-slip device or as a multi-purpose tip. Illustrative of these various cane tips is the crutch tip disclosed in U.S. Pat. No. 3,177,884 to Thro, where a composition or molded rubber cup has an insert holder molded into its end to accommodate a sharp-pointed, insertable projection to aid the user on icy surfaces. U.S. Pat. No. 4,098,283 to Tritle, Jr. discloses a disk with a lower convex surface for crutch operation on sand, and alternative disks are provided for use on snow or ice. Variation of the disks requires removal of the previous disk and insertion of the new disk by affixing it to a washer inserted in the crutch tip. Earlier attempts to accommodate alternative crutch tips included a tip which could be screwed to the cane end, that is again mating of male and female threaded members.

The earlier cane and tip assemblies are not generally easily assembled and disassembled for conversion between a monopod cane and a multitipped cane assembly with pads on the multiple tips having wide profiles and elongate arms to minimize slippage and maximize traction and load distribution.

SUMMARY OF THE INVENTION

The present invention provides an easily convertible cane, which is operable between a traditional monopod cane and a multipod walker or cane structure merely by inserting the monopod into an inconspicuously sleeved subassembly and tightening a single securing means, such a screw or nut. The cane height is adjustable to accommodate the height of the user or users for both modes. The subassembly sleeve has a tapered bottom to accept monopod cane tip changes as it wears. An annular member on the cane shaft is positioned in the sleeve and secured by tightening a single bolt to clamp a pair of sleeve flanges, which are separated by a slit in the sleeve. The annular member is maintained in position prior to securing by a spring-loaded ball and detent arrangement.

Horseshoe or U-shaped tips are secured on the multipod leg ends, which U-shaped tips provide greater stability against slippage.

The cane assembly is easily changed between the two operating modes. In addition, height adjustment is also easily accommodated by merely sliding male and female members along each other and securing desired height locations by a rod or spring-biased button in aligned holes or ports in the mated members.

BRIEF DESCRIPTION OF THE DRAWINGS

In the figures of the Drawing, like reference numerals identify like components, and in the drawing.

DETAILED DESCRIPTION OF THE PREFERRED EMBODIMENT

Canes and crutches are utilized to assist individuals who may be recovering from an injury, accident or surgery, as well as those parties suffering with maladies that inhibit their mobility. The single-shaft cane, which ends in a tip or monopod, is a common walking aid. However, the single-tipped cane is not adaptable for everyone in view of the difficulty associated with balancing the individual's weight on the narrow tip. Therefore, multitipped cane apparatus are utilized at the tip of a cane to distribute the load and provide more stable support and balance to an ambulatory party. Unfortunately a multitipped cane is not always appropriate for all environments, situations and individuals. Consequently a cane or walking aid adaptable to different people or to the same party in changing environments is a very desirable structure. The multimodal apparatus must be easily assembled or disassembled and it must also provide for changes in handle height to accommodate the changed structure or different user.

The present invention provides an easily assembled and disassembled cane, which is operable as a single-tipped or monopod cane, and is convertible to a multitipped cane by mating with a multipodded subassembly. The cane and subassembly mating is secured by a single, simplistic element, such as a screw or wing nut. The cane structure is designed to accommodate wearing changes or variations in the single-tipped end of the cane, thus obviating extraneous adjustment or removal of the monopod cane tip by the user when changing the cane structure between the two modes. In addition, horseshoe or U-shaped pads are provided on the multitipped subassembly, which pads further distribute the load borne by the cane shaft, thus providing the user even greater stability against slipping while utilizing the multitipped cane mode.

Figure 1:
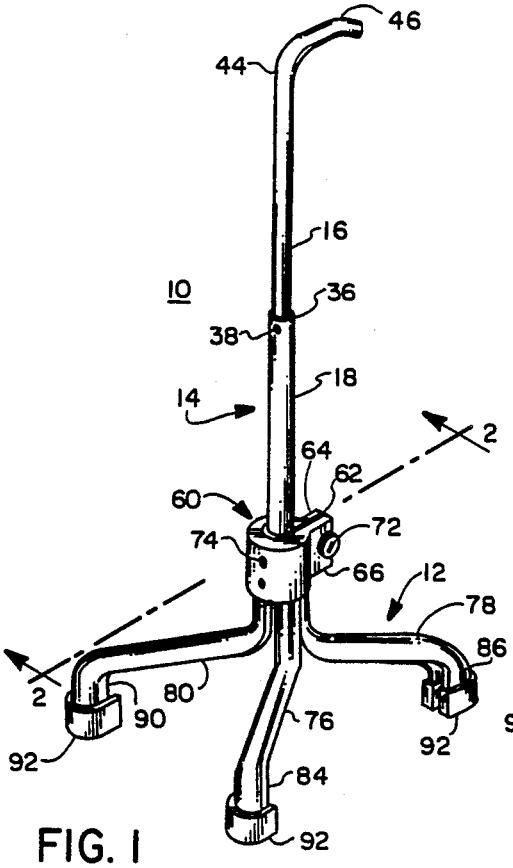
FIG. 1 is a perspective view of the cane assembly in the multipod mode.
Figure 7:
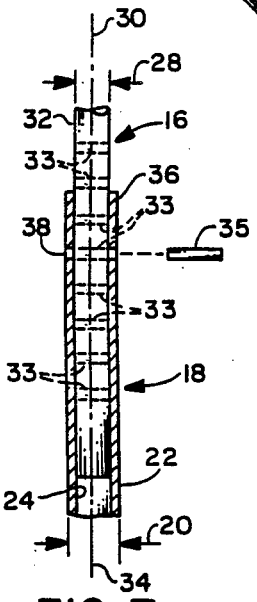

A cane assembly 10 is illustrated in FIG. 1 and has a multitipped subassembly 12 coupled to a cane shaft 14. Shaft 14 is a two-part arrangement with an upper segment 16 and a lower segment 18, which are shown as tubular members. In FIG. 7, lower segment 18 is a tubular member with a first diameter 20, an outer surface 22 and an inner surface 24. Upper segment 16 may be a solid rod or a tube member with a second tube diameter 28, an inner wall 30 and an outer wall 32, which second diameter 28 is smaller than first diameter 20. Upper and lower segments 16,18 are concentric about longitudinal axis 34 with upper segment 16 slidably mated in lower segment 18. Lower segment 18 has an upper end 36 with a through-bore or cross-bore 38 in proximity to upper end 36 and transverse to axis 34, and a lower end 40 to receive a wearing pad 42, as noted in FIG. 3, for use as a cane tip for a single-tipped cane. Upper segment 16 includes a top end 44 with a handle 46 integrally mounted thereon, although a separate, mountable handle is within the purview of the present invention. A plurality of cross-passages 33 are provided along the length of upper segment 16 and are transverse to axis 34, which passages 33 are occluded as upper segment 16 projects into lower segment 18. Alignment of any of passages 33 with cross-bore 38 of lower segment 18 and insertion of securing pin 35 will fix the relative height or length of shaft 14.

Figure 2:
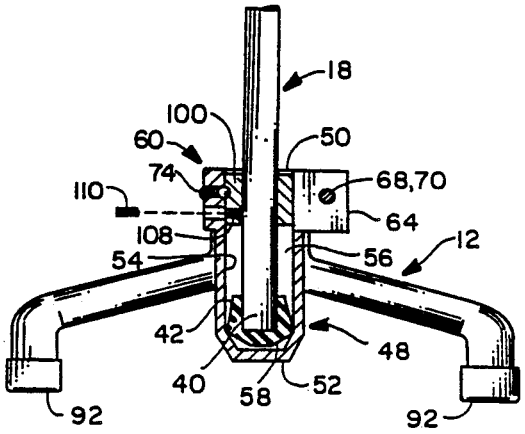
FIG. 2 is an elevational view in partial section along the line 2—2 of FIG. 1.

Multitipped subassembly 12, shown as a quadrapod in the Figures, has an upright sleeve 48 with an upper, open end 50, a lower and sealed end 52, an inner wall 54, and a cavity 56, which inner wall 54 and cavity 56 are inwardly tapered at lower, sealed end 52 with shoulder 58, as seen in FIG. 2. A collar 60 in FIGS. 1 and 2 extends around the perimeter of sleeve 48 at upper end 50 and has a slit 62 partially extending downward from upper end 50 and parallel to axis 34. A first flange 64 and a second flange 66 outwardly, radially protrude from either side of slit 62. Flanges 64,66 have first and second apertures 68,70, respectively, which may be threaded, to receive a securing means, such as a screw 72 with a knurled end for ease of clamping or drawing first and second flanges 64, 66 together. Collar 60 includes a port 74 extending from the outer surface of the collar to cavity 56.

Figure 3:
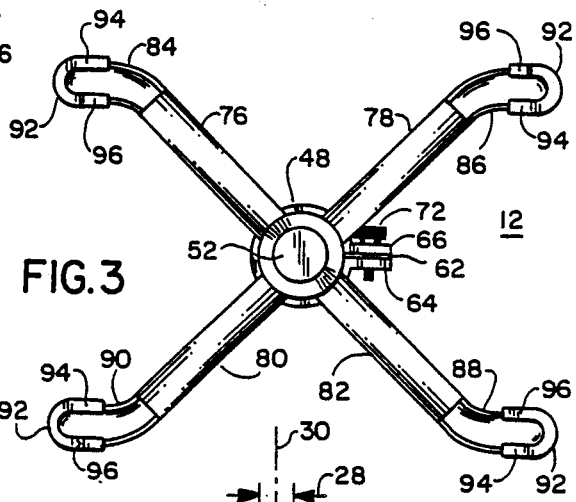
FIG. 3 is a bottom plan view of a preferred embodiment of the multipod assembly.
Figure 4:
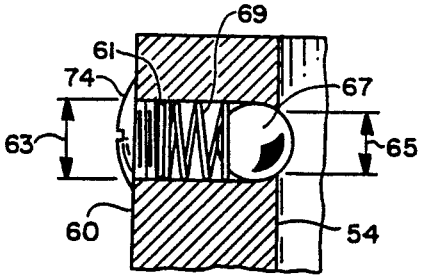
FIG. 4 is an enlarged, sectional view of the ball and detent arrangement for retaining the collar of the elongate member.

In FIG. 3, subassembly 12 has four arms 76,78,80 and 82 extending from sleeve 48, which arms generally cooperate to form the diagonals of a rectangle in this plan view. However, the individual pods or feet 84, 86, 88 and 90 of each of the respective arms 76–82 are acutely angled; are aligned parallel and project lengthwise in opposed directions along the length of the rectangle from the extreme ends of the aligned and parallel arms; and, are approximately aligned with one of the other pair of aligned arms, along the width of the above-noted rectangle. The individual pods or feet 84–90 have a U-shape and pads 92 have a similar horseshoe or U-shape to mate with and be mounted upon the feet 84–90. The U-shape of pads 92 provides the pods 84–90 with extended arms 94 and 96 for greater force and load distribution and consequently a more stable base for cane 10. It is, of course, contemplated that the feet and pads form a planar surface. Pads 92 may be of any pliable material with the wear and durability characteristics necessary for this application, which material should lend itself to being formed or mounted on the pod ends. Historically, a pliable rubber composition has been frequently utilized for cane ends. Similar material or material characteristics apply to the wearing tip 42.

Figure 5:
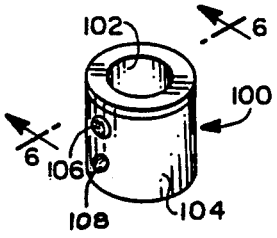
FIG. 5 is a perspective view of the mounting collar.
Figure 6:
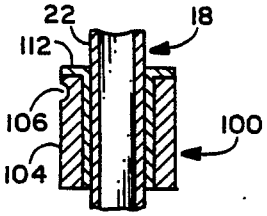
FIG. 6 is an elevational view in section of the collar along the line 6—6 in FIG. 5; and, FIG. 7 is a partial sectional view of the mated cane shafts.

An annular member 100, as illustrated in FIGS. 2, 5 and 6, has a central bore 102 to receive lower segment 18, an outer surface 104 and a depression or detent 106 on outer surface 104. A securing passage 108 extends through annular member 100 from outer surface 104 to central bore 102 and may be threaded to receive a securing means 110, which may be a threaded set screw. Annular member 100 can be secured to lower segment 18 by inserting securing means 110 through aligned aperture 74 and securing passage 108. In addition, collar 60 has an opening 61 extending into cavity 56 with a first diameter 63 and a second, smaller diameter 65 at the sleeve inner surface 54. A contact element 67, which is shown as a ball, is positioned in opening 61 and is freely movable in first diameter 63 but too large to pass through second diameter 65. A bias spring 69 is positioned in opening 61 and a seal 71 secures the ball 67 and spring 69 in opening 61. Spring 69 biases ball 67 to second diameter opening and at least a part of the ball surface protrudes into cavity 56 and is operable to nest in detent 106 of annular member 100 to temporarily secure the member in sleeve 48 along lower segment 18 for securing by screw 110. In an alternative embodiment annular member 100 may have an insert bushing 112 provided in central bore 102, which bushing is operable as a bearing component, provides a more secure fit for shaft 14 and allows smoother movement of lower segment 18 in annular member 100.

Cane 10 is operable in its monopod mode with wearing tip 42 on cane end 40. Annular member 100 is mounted on this lower cane end and maintained in position by the contact of screw 110 against lower segment 18. The cane height and thus the position of handle 46 are adjustable by aligning any of the plurality of passages 33 with cross bore 38 by sliding upper segment 16 into lower segment 18 and thereafter inserting pin 35 into the aligned passage and bore. Alternatively, a spring-loaded button assembly, as utilized in joining tubular members of canister vacuum cleaner attachments, for example, or as illustrated in U.S. Pat. No. 4,085,763 at FIG. 3, may be used to secure the aligned bore and passage. Thereafter, cane 10 is operable in a conventional manner as a walking aid.

Conversion of cane 10 from the monopod mode to the multitipped or multipod mode is accomplished quickly and with a minimal effort. Wearing tip 42, lower segment 18 and annular member 100 are inserted into sleeve cavity 56. The position of annular member 100 on lower segment 18 may be adjusted by loosening or removing screw 110 and moving member 100 in cavity 56 for engagement of ball 67 into detent 106 and then securing screw 110 against lower segment 18 by insertion of a tightening means through passage 74 in collar 60. Wearing tip 42 is thus nested against the tapered shoulder 58 at the lower end 52 of sleeve 48 and annular member 100 is secured in position in proximity to the upper end 50 of sleeve 48. Flanges 64 and 66 are tightened by locking screw 72, which draws the flanges together to narrow the width of slit 62 and to securely clamp annular member 100 and shaft 14 to subassembly 12 to provide a multitipped cane with greater stability. Lower end 52 of sleeve 48 is in close proximity to the planar surface defined by the pads 92 and thus lower end 40 of lower shaft segment 18 is in close proximity to the ground-contacting surface to minimize the height adjustment of shaft 14 and to further improve cane stability in the multipod mode. While only specific embodiments of the invention have been described and shown, it is apparent that various alterations and modifications can be made therein. It is, therefore, the intention in the appended claims to cover all such modifications and alterations as may fall within the scope and spirit of the invention.

What is claimed is:

1. A dual-mode, easily convertible cane assembly operable in a monopod mode and a multitipped mode, said cane assembly comprising:

an elongate member with a first end and a second end;

a handle positioned at one of said first and second ends;

a first wearing element mounted at the other of said first and second ends, which first wearing element is operable as a monopod cane end;

a support section defining an essentially close end and a cavity therein, said cavity receives said first wearing element and a segment of said elongate member other end;

a multipod pedestal having at least three arms, each of said arms having a first end and a second end, each of said arms coupled to said support section at one of said arm first and second ends;

a plurality of second wearing elements, one of said second wearing elements mounted at the other of said first and second ends of each of said arms; and, means for securely locating and rigidly coupling said elongate member and first wearing element in said support section cavity for conversion of said monopod cane to said multitipped cane mode.

2. A cane assembly as claimed in claim 1 wherein said support section is a sleeve with a tube wall, a closed end and a open end;

said sleeve having a longitudinal axis and a slit, said slit extending a short distance along said tube wall from said open end and having a slit width generally parallel to said axis;

a first flange and a second flange mounted at said tube open end and extending radially outward from said tube wall and longitudinal axis with said slit therebetween;

said first and second flanges defining a first aperture and a second aperture, which first and second apertures are aligned; and, means for securing extending through said apertures and operable to move said first and second flanges to contract and expand the slit width to secure said means for locating and coupling said elongate member in said sleeve.

3. A cane assembly as claimed in claim 2 wherein said mounted second wearing elements cooperate to define a plane, said tube wall closed end is a lower extremity, which lower extremity is in proximity to said plane to position said elongate member first wearing element in proximity to said second wearing elements to provide greater stability to said cane assembly in said multitipped mode.

4. A cane assembly as claimed in claim 3 wherein said tube wall has an interior surface and an outer surface; said interior surface at said closed end is conically shaped and outwardly convex to receive, maintain and accommodate size variations in said elongate member first wearing element, and said first wearing element and elongate member in a securely nested position to stabilize the cane and pedestal assembly.

5. A cane assembly as claimed in claim 1 wherein said elongate member is a shaft with a first cylindrical segment and a second cylindrical segment;

said first cylindrical segment having a first sidewall, a central bore, a first end, a second end and a securing-pin port through said first sidewall at one of the first and second ends;

second means for securing;

said first wearing element mounted on the other of said first-segment first and second ends;

said second cylindrical segment having a second sidewall, a first end, a second end and a longitudinal axis;

said handle mounted on one of said first and second, second-segment ends;

a plurality of cross-bores through said second segment, which cross bores are transverse to said longitudinal axis and are spaced along said second-segment length from said other of said first and second, second-segment ends;

said second segment matable with said first segment and adjustable along said cylindrical segments by mating said second securing means through aligned securing-button port and one of said cross-bores.

6. A cane assembly as claimed in claim 5 wherein said second securing means is securing pin.

7. A cane assembly as claimed in claim 1 wherein said second wearing elements are U-shaped pads, said pads having a first pad arm, a second pad arm and an arcuate base coupling said first and second pad arms;

said first and second arms intersecting said arcuate base at approximately a tangent thereto and extending about parallel from said arcuate base.

8. A cane assembly as claimed in claim 7 wherein said U-shaped pads are rubber.

9. A dual-mode, easily convertible cane assembly operable in a monopod mode and a multitipped mode, said cane assembly comprising:

an elongate member with a first end and a second end;

a handle positioned at one of said first and second ends;

a first wearing element mounted at the other of said first and second ends, which first element is operable as a monopod cane end;

a sleeve with a tube wall, a closed end an upper section with an open end, an interior surface, and an outer surface, said sleeve defining a cavity for said first wearing element and elongate member other end, said interior surface at said closed end being generally conically shaped and outwardly convex to receive and accommodate size variations in said first wearing element;

said sleeve having a longitudinal axis and slit, which slit extends a short distance along said tube wall from said open end and has a slit width generally parallel to said axis;

a first flange with a first aperture and a second flange with a second aperture at said tube open end, which first and second apertures are aligned, said first and second flanges extending radially outward from said tube wall and longitudinal axis with said slit therebetween;

a multipod pedestal having at least three arms, each of said arms having a first end and a second end, each of said pedestal arms coupled to said sleeve at one of said pedestal arm first and second ends;

a plurality of second wearing elements, one of said second wearing elements mounted at the other of said first and second ends of each of said pedestal arms which second wearing elements cooperate to generally define a plane, said tube wall closed end in proximity to said plane to position said first wearing element in proximity to said second wearing elements to provide said cane assembly with greater stability in said multitipped mode;

means for securely locating and coupling said elongate member and first wearing element in said sleeve cavity for conversion of said monopod cane to said multitipped cane mode;

means for securing extending through said first and second flange apertures and operable to move said first and second flanges to contract and expand the slit width to secure said means for locating and coupling in said sleeve;

said tube wall having a through-bore extending through said upper section, said through-bore having a first diameter at said sleeve outer surface and a second diameter at said interior wall surface which second diameter is less than said first diameter;

a contact means with a boundary surface, which contact means is nested in said through-bore;

means for closing said through-bore at said outer surface; and, means for biasing said contact means, which biasing means is positioned in said through-bore between said closing means and contact means to bias said contact means into said interior surface second diameter with at least a portion of said boundary surface extending from said through-bore into said cavity.

10. A cane assembly as claimed in claim 9 wherein said location means is an annular member with a central passage, an outer surface, and a detent in said annular member outer surface;

said elongate member extending through said central passage;

said contact means mating with said detent in said sleeve cavity to temporarily maintain said annular member at said sleeve upper section for securing in said cavity by said first and second flange contraction.

11. A cane assembly as claimed in claim 9 wherein said sleeve further comprises an annular collar at said sleeve upper end, which collar radially extends from said sleeve;

said slit extending through said collar;

said first flange and second flange extending from said collar;

said through-bore extending through said collar;

said collar defining a securing port extending from said outer surface into said cavity;

said annular member defining securing port extending from said outer surface to said central passage;

third means for securing;

said third securing means positioned and secured in said securing port and operable to contact and secure said annular member on said elongate member.

12. A cane assembly as claimed in claim 11 wherein said third securing means is a threaded set screw and said annular member, securing through-port is threaded to mate with said threaded set screw to secure said annular member on said elongate member.

* * * * *

UNITED STATES PATENT AND TRADEMARK OFFICE

CERTIFICATE OF CORRECTION

PATENT NO. : 4,997,001

DATED : March 5, 1991

INVENTOR(S) : Tom R. DiCarlo

It is certified that error appears in the above-identified patent and that said Letters Patent is hereby corrected as shown below:

Column 6, Line 56, after "is" insert --a--.

Column 7, Line 7, after "end" insert a comma.

Signed and Sealed this

Twelfth Day of January, 1993

*Attest:*

DOUGLAS B. COMER

*Attesting Officer*

*Acting Commissioner of Patents and Trademarks*